US012053095B1

(12) United States Patent
Shi

(10) Patent No.: US 12,053,095 B1
(45) Date of Patent: Aug. 6, 2024

(54) INFLATABLE BED WITH AIR PERMEABILITY

(71) Applicant: Dongguan Hongyu Plastic Co., Ltd., Guangdong (CN)

(72) Inventor: Juying Shi, Guangdong (CN)

(73) Assignee: Dongguan Hongyu Plastic Co., Ltd., Guangdong (CN)

( * ) Notice: Subject to any disclaimer, the term of this patent is extended or adjusted under 35 U.S.C. 154(b) by 0 days.

(21) Appl. No.: 18/599,397

(22) Filed: Mar. 8, 2024

(30) Foreign Application Priority Data

Feb. 4, 2024 (CN) ..... 202420277368.1

(51) Int. Cl.
*A47C 27/00* (2006.01)
*A47C 27/08* (2006.01)
*A47C 27/18* (2006.01)

(52) U.S. Cl.
CPC ..... *A47C 27/007* (2013.01); *A47C 27/081* (2013.01); *A47C 27/18* (2013.01)

(58) Field of Classification Search
CPC ..... A47C 27/007; A47C 27/081; A47C 27/18; A47C 27/148; A47C 27/443; A47C 27/123; A47C 27/006; A47C 31/105
USPC ..... 5/652.2
See application file for complete search history.

(56) References Cited

U.S. PATENT DOCUMENTS 6,003,178 A * 12/1999 Montoni ..... A47C 27/20 5/241
11,324,335 B2 * 5/2022 Huang ..... A47C 31/116
2003/0188388 A1 * 10/2003 Boso ..... A47C 27/087 5/713
2005/0115003 A1 * 6/2005 Torbet ..... A47C 27/10 5/730
2008/0244832 A1 * 10/2008 Kuo ..... A47C 27/007 5/490
2009/0056030 A1 * 3/2009 Bolden ..... A61G 7/05792 5/713
2014/0237728 A1 * 8/2014 Oh ..... A47C 27/146 5/730
2016/0015183 A1 * 1/2016 Stjerna ..... A47C 27/061 5/690
2020/0100598 A1 * 4/2020 Huang ..... A47C 27/087

FOREIGN PATENT DOCUMENTS

CN 218390461 U * 1/2023
CN 218651120 U * 3/2023
CN 218773641 U * 3/2023 ..... A47C 27/082
CN 220713473 U * 4/2024

* cited by examiner

*Primary Examiner* — Myles A Throop
(74) *Attorney, Agent, or Firm* — Cooper Legal Group, LLC

(57) ABSTRACT

An inflatable bed with air permeability includes a bed body including a top panel, an enclosing wall and a bottom panel, a top cover, a first pull strap, and a second pull strap which are both endless. A top side of the first pull strap is connected to an inner wall of the top panel, and a bottom side of the first pull strap is connected to an inner side wall of the enclosing wall. A bottom side of the second pull strap is connected to an inner wall of the bottom panel, and a top side of the second pull strap is connected to the inner side wall of the enclosing wall. The first net-shaped pull strap includes two first air permeable sections parallel to each other, two second net-shaped air permeable sections parallel to each other and four connection sections distributed in a rectangular array.

13 Claims, 8 Drawing Sheets

A

INFLATABLE BED WITH AIR PERMEABILITY

CROSS-REFERENCE TO RELATED APPLICATION

The present application is based on and claims the priority benefits of China application No. 202420277368.1, filed on Feb. 4, 2024. The entirety of China application No. 202420277368.1 is hereby incorporated by reference herein and made a part of this specification.

TECHNICAL FIELD

The present application relates to the field of inflatable beds, and in particular, to an inflatable bed with air permeability.

BACKGROUND ART

The inflatable bed is conducive to overcoming a defect that the traditional furniture is heavy, which can be placed indoor and outdoor at will.

The existing technology discloses an inflatable bed including a bed body, an air pump and a one-way valve. The bed body is provided with a bed body cavity and a bed edge cavity which are independent from each other, and the bed edge cavity is arranged around the bed body cavity. The air pump is connected to the bed body, and the air pump is configured to inflate the bed body cavity and the bed edge cavity. The one-way valve is provided on the air pump or the bed body, and the one-way valve is configured to only allow fluid to enter the bed body cavity. The surface of the bed body is made of PVC, and the PVC material has good corrosion resistance, thereby extending the service life of the inflatable bed.

In view of the above-mentioned technology, there are following defects: since the surface of the bed body in the existing technology is made of PVC material with poor air permeability, the air permeability of the surface of the bed body is reduced. In use, it is difficult for the human body and the surface of bed body in contact to dissipate the excess heat and moisture emitted by the human body, which reduces the overall comfort.

SUMMARY

In order to improve the air permeability of the bed body surface, an inflatable bed with air permeability is disclosed.

The inflatable bed with air permeability disclosed is provided with the following technical solution.

An inflatable bed with air permeability includes a bed body and a top cover, in particular, the top cover is connected to the bed body and is configured with a plurality of first air holes, and a sponge pad is provided between the bed body and the top cover.

By adopting the above-mentioned technical solution, since the plurality of first air holes are defined on the top cover, and the sponge pad is provided between the top cover and the bed body, the air may flow from the first air holes of the top cover to the sponge pad and be discharged from the sponge pad, thus increasing the air permeability of the surface of the inflatable bed.

Optionally, a surface of the bed body is provided with an annular side border, and an edge of the top cover is fixedly connected to the annular side border.

By adopting the above-mentioned technical solution, the side border not only plays a role in positioning the top cover, but also plays a role in protecting the sponge pad, and additionally improves the overall aesthetics of the inflatable bed.

Optionally, the plurality of first air holes are micro-holes.

By the above-mentioned technical solution, the first air holes are micro-holes, which not only ensures the air permeability of the top cover, but also improves the overall aesthetics of the top cover, at the same time, by which the pressure on the human body from the top cover is reduced, thereby improving the overall comfort.

Optionally, a plurality of second air holes are defined on the annular side border.

By adopting the above-mentioned technical solution, the air flows into the sponge pad inside the side border through the plurality of first air holes on the top cover, and then flows out through the plurality of second air holes on the side border, thereby increasing the overall airway patency, and at the same time, it is convenient for the air to take away the excess heat and moisture emitted by the human body during the flow, thereby improving the overall comfort.

Optionally, the sponge pad is located in the annular side border.

By adopting the above-mentioned technical solution, because of the special nature of the material of the sponge pad, the inflatable bed has a certain elasticity, such that it is capable of adapting to the shape of the human body to make the person sleep more comfortable. At the same time, the sponge pad also possesses a good air permeability, so that the person is less likely to sweat when sleeping, thereby improving the sleep quality.

Optionally, a support device is provided in the bed body and includes a bearing board and a plurality of support mechanisms, a bottom end of each of the plurality of support mechanisms is fixedly connected to the bed body, a top end of each of the plurality of support mechanisms is fixedly connected to the bearing board, and the bearing board is configured to support the sponge pad and the top cover.

By the above-mentioned technical solution, the plurality of support mechanisms have a stable supporting effect on the bearing board, and the bearing board has a supporting effect on the sponge pad and the top cover on the surface of the bed body, so as to ensure that the inflatable bed does not deform during long-term use, which extends the service life of the inflatable bed as a whole.

Optionally, each of the plurality of support mechanisms includes a first buffer assembly and a second buffer assembly, the first buffer assembly is provided in the bed body, the second buffer assembly is provided on the first buffer assembly, the second buffer assembly is configured to support the bearing board, and a side of the bearing board away from the second buffer assembly abuts against the bed body.

By the above-mentioned technical solution, the first buffer assembly supports the second buffer assembly upwards, the second buffer assembly supports the bearing board upwards, and additionally, the first buffer assembly and the second buffer assembly have a buffering effect at the same time, so that a person sleeps more comfortably.

Optionally, the first buffer assembly includes a bracket, a buffer block and a plurality of first elastic elements, the bracket is fixed in the bed body, the buffer block is located in the bracket, a first end of each of the plurality of first elastic elements is connected to the buffer block, a second end of each of the plurality of first elastic elements is connected to the bracket, and the second buffer assembly is provided on the buffer block.

By adopting the above-mentioned technical solution, since the bracket is fixed in the bed body, the bed body plays a role in fixing and supporting the bracket. Since one end of each first elastic element is connected to the buffer block while the other end of each first elastic element is connected to the bracket, and the second buffer assembly is provided on the buffer block, therefore, when a person generates pressure on the top cover, the sponge pad and the bearing board when sleeping, the bearing board generates a pressure on the second buffer assembly, the second buffer assembly in turn generates a pressure on the buffer block, such that the buffer block drives the plurality of first elastic elements to elastically deform at the same time. Therefore, when the sleeping posture of the person is changed, the plurality of first elastic elements generate an upward elastic force due to their own elastic potential energy, thereby ensuring that the top cover and the sponge pad are changed with the change of the sleeping posture, thereby improving the overall comfort.

Optionally, the second buffer assembly includes a guide cylinder, a support rod and a second elastic element, two ends of the guide cylinder are open, a bottom end of the two ends of the guide cylinder is fixedly connected to the buffer block, a top end of the support rod is fixedly connected to the bearing board, a bottom end of the support rod is located in the guide cylinder, the support rod is in sliding fit with the guide cylinder, the second elastic element is located in the guide cylinder, a top end of the second elastic element abuts against the support rod, and a bottom end of the second elastic element abuts against a surface of the buffer block.

By adopting the above-mentioned technical solution, since both ends of the guide cylinder are open, it is convenient for a worker to insert the spring and the support rod into the guide cylinder. When a person generates pressure on the top cover, the sponge pad and the bearing board when sleeping, the bearing board presses the support rod to descend, and in turn the support rod compresses the second elastic element during the descending process, at this time, the plurality of first elastic elements and the plurality of second elastic elements are all elastically deformed. Therefore, when the sleeping posture of the person is changed, the plurality of first elastic elements and the plurality of second elastic elements generate an upward elastic force due to their own elastic potential energy, thereby ensuring that the top cover and the sponge pad are changed with the change of the sleeping posture, thereby improving the overall comfort.

Optionally, an inner side wall of the guide cylinder is configured with a guide groove, a bottom end of the guide groove is open, a guide block is fixedly provided on the support rod, the guide block is located in the guide groove, and the guide block is in sliding fit with the guide groove.

By adopting the above-mentioned technical solution, since the bottom end of the guide groove is open, the guide block is easily pushed into the guide groove from the bottom end of the guide groove. When the support rod slides in the guide cylinder, the guide block slides in the guide groove, the guide groove has a guiding effect on the guide block, which increases the sliding stability of the guide block, thereby increasing the sliding stability of the support rod.

Optionally, the bed body includes a top panel, an enclosing wall and a bottom panel, particularly, the enclosing wall is annular, an edge of the top panel is fixedly connected to a top end of the enclosing wall, and an edge of the bottom panel is fixedly connected to a bottom end of the enclosing wall.

Optionally, the inflatable bed with air permeability further includes a first pull strap and a second pull strap, particularly, the first pull strap and the second pull strap are both endless, a top side of the first pull strap is connected to an inner wall of the top panel, and a bottom side of the first pull strap is connected to an inner side wall of the enclosing wall, in particular, a bottom side of the second pull strap is connected to an inner wall of the bottom panel, and a top side of the second pull strap is connected to the inner side wall of the enclosing wall, and particularly, the first pull strap includes two first air permeable sections, two second air permeable sections and four connection sections, the two first air permeable sections are parallel to each other, the two second air permeable sections are parallel to each other, the four connection sections are distributed in a rectangular array, and the first air permeable sections and the second air permeable sections are respectively in a net shape.

Optionally, the sponge pad is provided with a plurality of first subzones and a plurality of second subzones, the plurality of first subzones and the plurality of second subzones are successively arranged at intervals along a length direction of the sponge pad, and a thickness of the plurality of first subzones is greater than a thickness of the plurality of second subzones. Optionally, an edge of the top cover is fixedly connected with the bed body.

In summary, at least one of the following beneficial technical effects is realized:

1. Since the plurality of first air holes are defined on the top cover, and a sponge pad is provided between the top cover and the bed body, the air may flow from the first air holes of the top cover to the sponge pad and be discharged from the sponge pad, thus increasing the air permeability of the surface of the inflatable bed; the side border not only plays a role in positioning the top cover, but also plays a role in protecting the sponge pad, and additionally improves the overall aesthetics of the inflatable bed.
2. The first air holes are micro-holes, which not only ensures the air permeability of the top cover, but also improves the overall aesthetics of the top cover, at the same time, by which the pressure of the top cover on the human body is reduced, thereby increasing the overall comfort.
3. The air flows into the sponge pad inside the side border through the plurality of first air holes on the top cover, and then flows out through the plurality of second air holes on the side border, thereby improving the overall airway patency, and at the same time, it is convenient for the air to take away the excess heat and moisture emitted by the human body during the flow, thereby improving the overall comfort.

DETAILED DESCRIPTION

The present application is described in further detail below with reference to FIGS. 1-8.

The terminology used herein is for describing particular embodiments only and is not intended to limit the present application. Unless defined otherwise, technical or scientific terms used herein shall have the ordinary meaning as understood by a person skilled in the art to which the present application belongs. The use of the terms "first", "second", and the like in the present application does not denote any order, quantity, or importance, but rather is used to distinguish one element from another.

Embodiment 1

Figure 1:
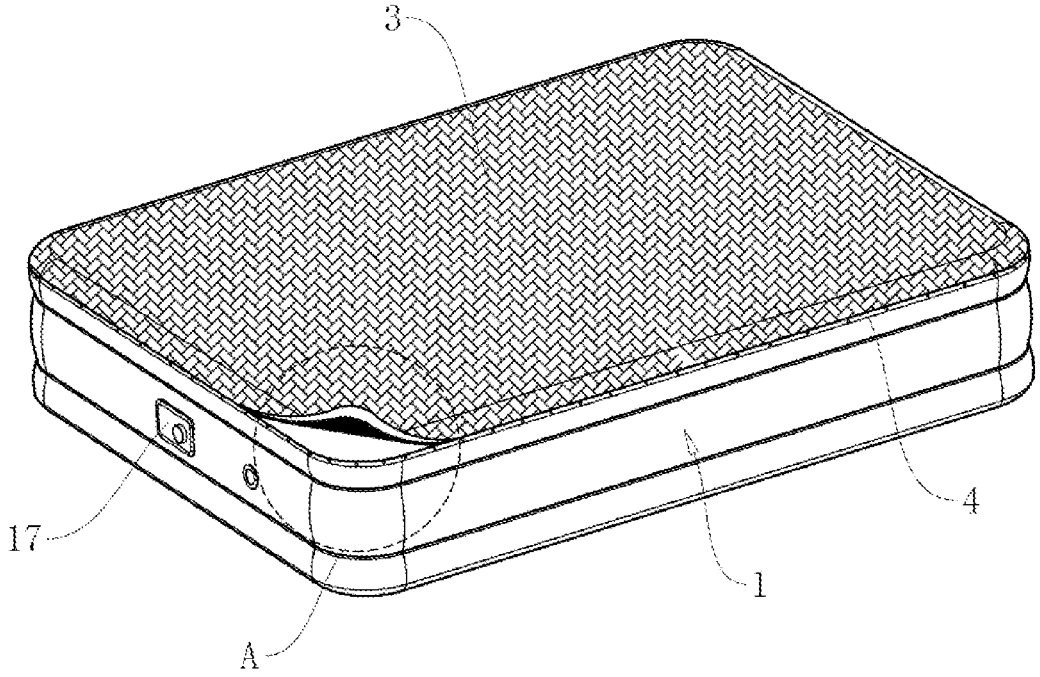
FIG. 1 is a schematic structural diagram showing an inflatable bed with air permeability according to Embodiment 1 of the present application.
Figure 2:
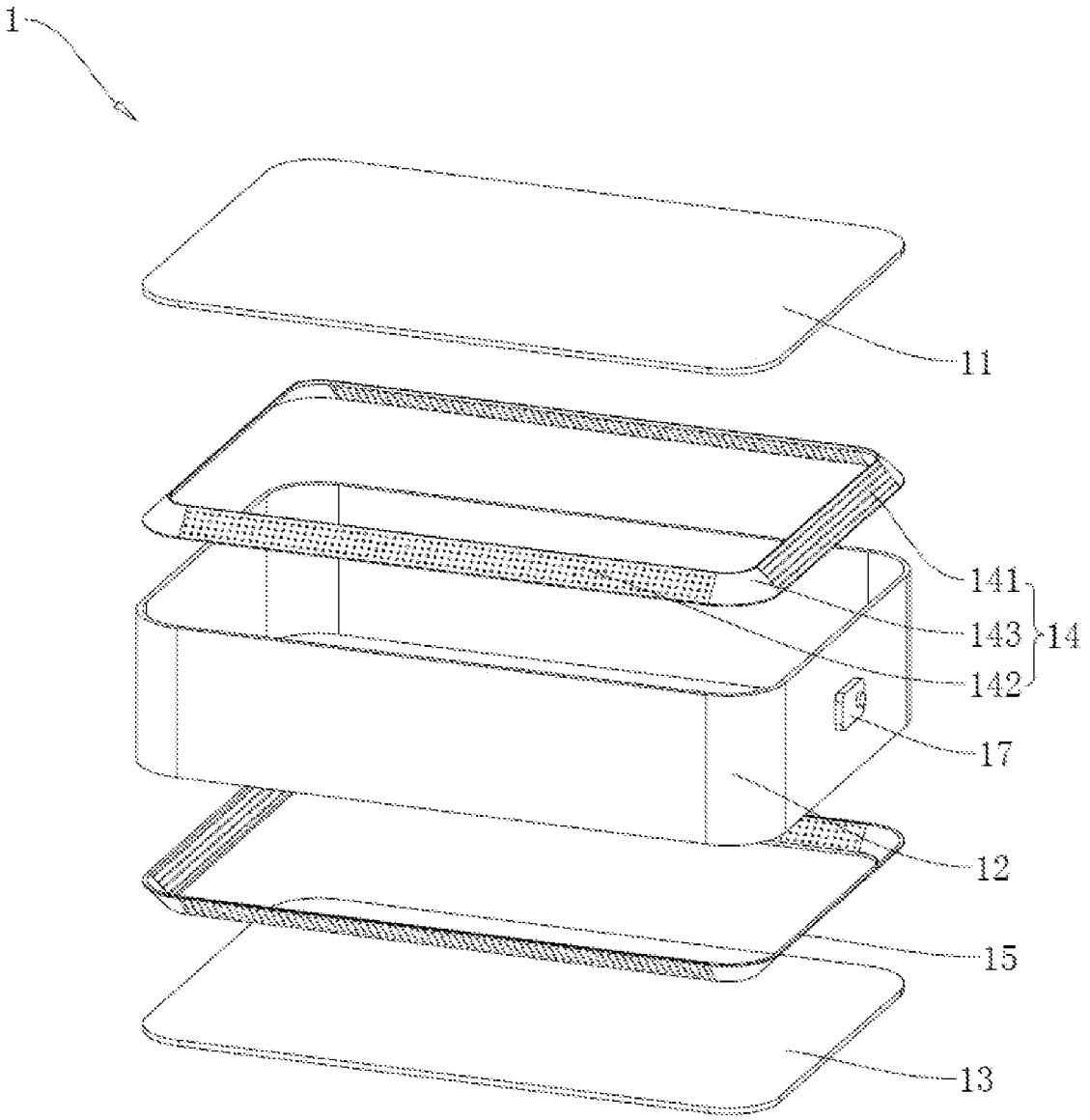
FIG. 2 is a schematic diagram showing the assembly relation of a bed body according to Embodiment 1 of the present application.

Embodiment 1 of the present application discloses an inflatable bed with air permeability. Referring to FIGS. 1 and 2, the inflatable bed with air permeability includes a bed body 1 including a top panel 11, an enclosing wall 12 and a bottom panel 13. The enclosing wall 12 is annular, the edge of the top panel 11 is fixedly connected to the top end of the enclosing wall 12, and the edge of the bottom panel 13 is fixedly connected to the bottom end of the enclosing wall 12, so that the bed body 1 forms a rectangular structure.

Figure 3:
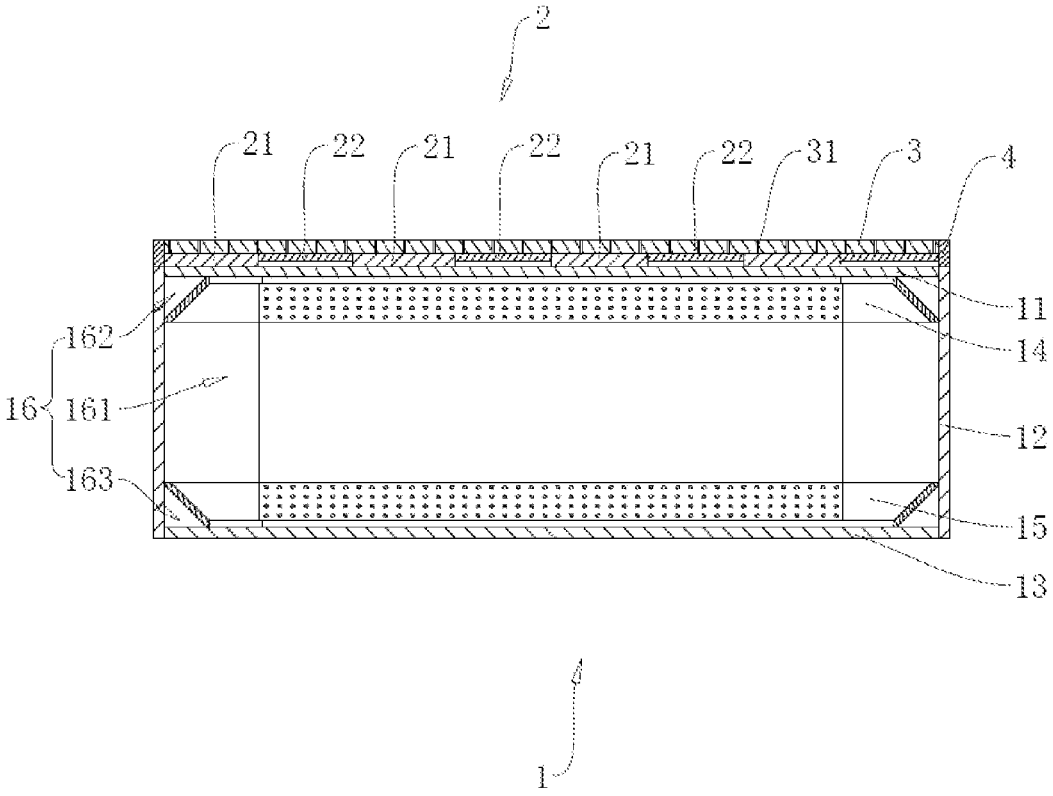
FIG. 3 is a half sectional view of the inflatable bed with air permeability according to Embodiment 1 of the present application.

Referring to FIGS. 2 and 3, the top panel 11, the enclosing wall 12 and the bottom panel 13 enclose an inner cavity 16 of the bed body 1. The first pull strap 14 and the second pull strap 15 are provided in the inner cavity 16, and the first pull strap 14 and the second pull strap 15 are symmetrical to each other. In the present embodiment, the first pull strap 14 and the second pull strap 15 are both endless, the top side of the first pull strap 14 is fixedly connected to the inner side wall of the top panel 11 while the bottom side of the first pull strap 14 is fixedly connected to the inner side wall of the enclosing wall 12. The bottom side of the second pull strap 15 is fixedly connected to the inner side wall of the bottom panel 13, and the top side of the second pull strap 15 is fixedly connected to the inner side wall of the enclosing wall 12. The first pull strap 14 and the second pull strap 15 divide the inner cavity 16 into a main cavity 161, an upper cavity 162 and a lower cavity 163.

Referring to FIG. 2, in the present embodiment, the first pull strap 14 includes two first air permeable sections 141, two second air permeable sections 142, and four connection sections 143. The two first air permeable sections 141 are parallel to each other, two second air permeable sections 142 are parallel to each other, four connection sections 143 are distributed in a rectangular array, two ends of each of the first air permeable sections 141 are integrally formed with two connection sections 143 respectively, and two ends of each of the second air permeable sections 142 are integrally formed with two connection sections 143. The first air permeable section 141 and the second air permeable section 142 are both configured with a plurality of air vents or are mesh-shaped respectively, so as to ensure the air exchange between the main cavity 161 and the upper cavity 162. The four connection sections 143 increase the support strength of the four corners of the first pull strap 14. The structure of the second pull strap 15 is identical to that of the first pull strap 14, so that the second pull strap 15 is also capable of ensuring the air exchange between the main cavity 161 and the lower cavity 163.

Referring to FIGS. 2 and 3, one side of the enclosing wall 12 is provided with an air pump 17 for inflating the main cavity 161. In the inflation process of the inflatable bed by the air pump 17, the air from the air pump 17 is firstly discharged into the main cavity 161, and the air in the main cavity 161 can flow not only into the upper cavity 162 through the first pull strap 14 but also into the lower cavity 163 through the second pull strap 15, so that the main cavity 161, the upper cavity 162 and the lower cavity 163 may be simultaneously inflated by the air pump 17.

Referring to FIGS. 1 and 3, the upper surface of the bed body 1 is fixedly provided with a side border 4, which is annular. A sponge pad 2 and a top cover 3 are provided in the side border 4, and the sponge pad 2 is located between the top cover 3 and the bed body 1. In some embodiments, the upper surface of the sponge pad 2 is fixedly connected to the lower surface of the top cover 3 by hot press, the edge of the top cover 3 is fixedly connected to the side border 4, and the side border 4 not only plays a role in positioning the top cover 3, but also plays a role in protecting the sponge pad 2, and improves the overall aesthetics of the inflatable bed. In other embodiments, the edge of the sponge pad 2 is connected with the inner circumference of the side border 4. Because of the special nature of the material of the sponge pad 2, the inflatable bed has a certain elasticity, such that it is capable of adapting to the shape of the human body to make the person sleep more comfortable. At the same time, the sponge pad 2 also possesses a good air permeability, so that people is less likely to sweat when sleeping, thereby improving the sleep quality.

Referring to FIG. 3, moreover, the sponge pad 2 is provided with a plurality of first subzones 21 and a plurality of second subzones 22, which are successively arranged at intervals along the length direction of the sponge pad 2. The thickness of the sponge pat in the first subzone 21 is greater than that of the sponge pad in the second subzone 22, thereby providing different support forces for different parts of the human body.

Figure 4:
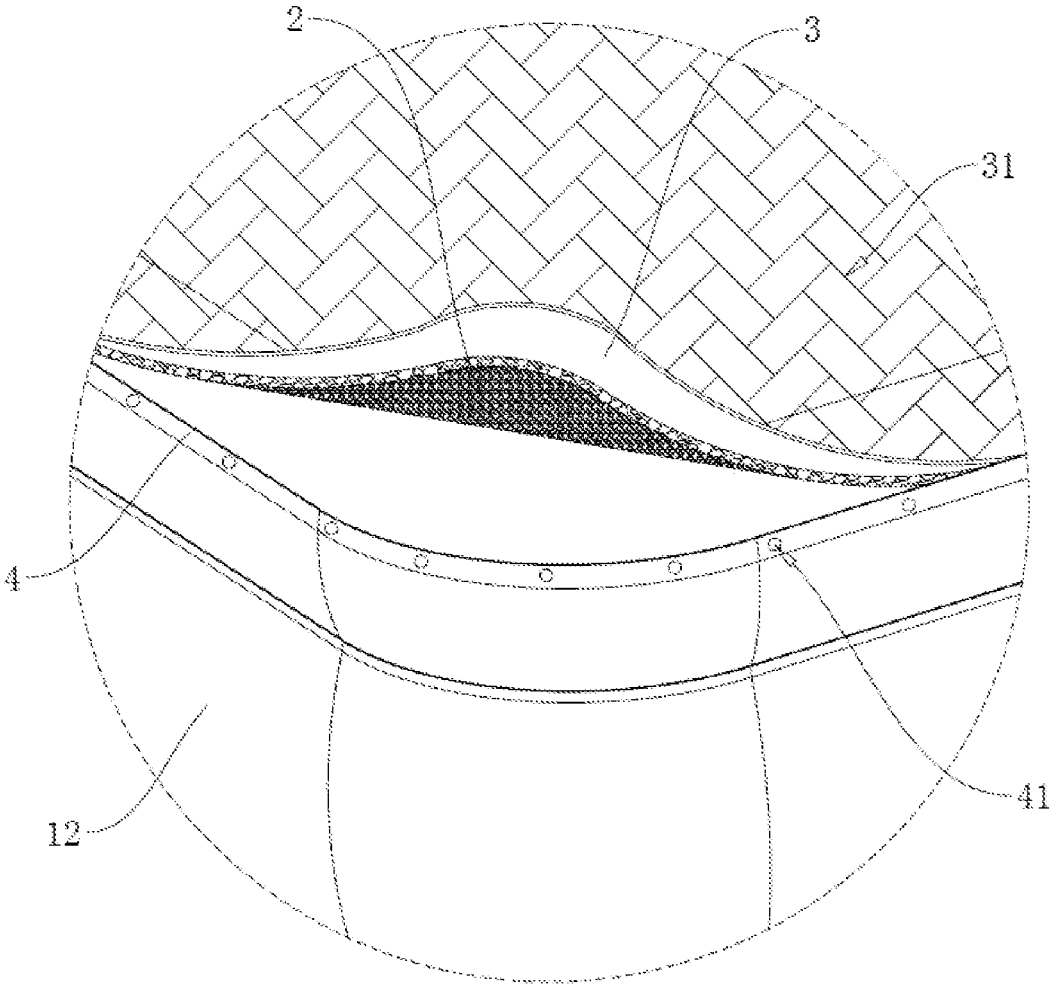
FIG. 4 is a partial enlarged view of portion A of FIG. 1.

Referring to FIG. 4, in the present embodiment, the top cover 3 and the side borders 4 may be made from PVC or flocked cloth. PVC is capable of withstanding high pressures and temperatures and is not susceptible to chemical corrosion and wear, while PVC is a non-flammable material with a certain flame resistance and a certain resistance to flames, thereby extending the service life of the top cover 3 and the side border 4. In a case where both the top cover 3 and the side borders 4 are made of the same material, the top cover 3 and the side borders 4 are more easily connected when the inflatable bed is manufactured.

Figure 5:
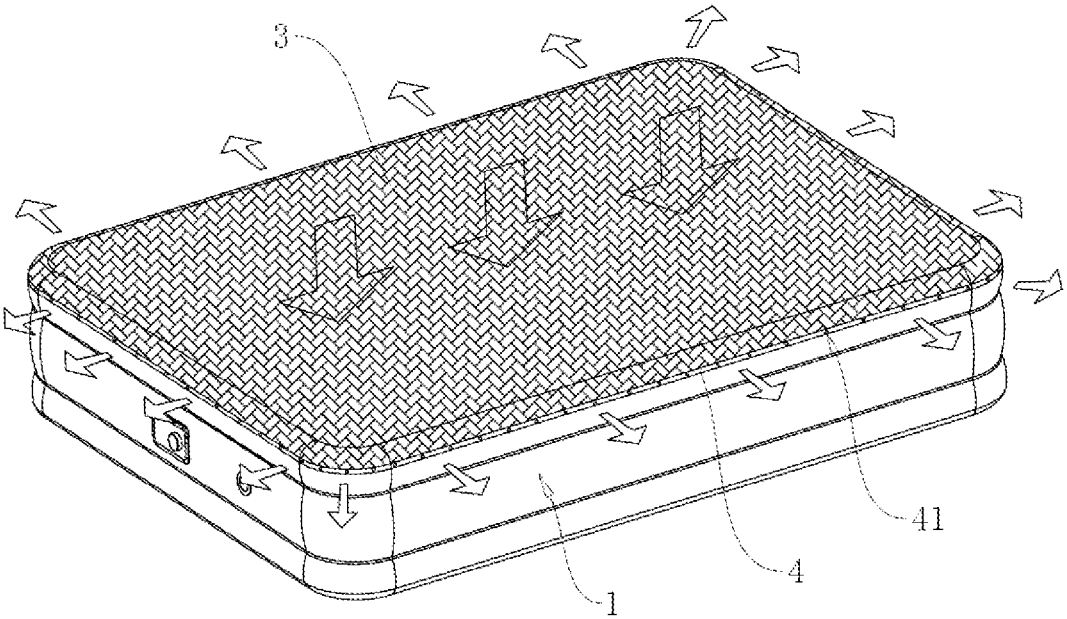
FIG. 5 is a schematic diagram showing the air flow of the inflatable bed with air permeability according to Embodiment 1 of the present application.

Referring to FIGS. 4 and 5, the top cover 3 is configured with a plurality of first air holes 31, and the side border 4 is configured with a plurality of second air holes 41. Since the top cover 3 is configured with a plurality of first air holes 31, the air permeability of the top cover 3 as a whole is improved, thereby improving the air permeability of the surface of the bed body 1. The air flows into the inside of the side border 4 through the plurality of first air holes 31 on the top cover 3 and then flows out through the plurality of second air holes 41 on the side border 4, thereby increasing the overall airway patency, and at the same time, it is convenient for the air to take away the excess heat and moisture emitted from the human body during flowing, thereby improving the overall comfort.

Referring to FIG. 4, the first air holes 31 are micro-holes, whose shape may be arbitrarily changed according to different requirements. The first air holes 31 are micro-holes, which not only ensures the air permeability of the top cover 3, but also improves the overall aesthetics of the top cover 3, and additionally improves the overall comfort due to the reduction of the pressure on the human body from the top cover 3. Specifically, a micro-hole refers to a hole having a minimum hole diameter less than or equal to 0.08 mm. The edges of the pattern on the top cover 3 may be formed by first air holes 31.

The implementation principle of Embodiment 1 described above is as follows. The air flows into the inside of the side border 4 through the plurality of first air holes 31 on the top cover 3 and then flows out through the plurality of second air holes 41 on the side border 4, thereby increasing the overall airway patency, and at the same time, it is convenient for the air to take away the excess heat and moisture emitted from the human body during the flow, thereby improving the overall comfort.

Embodiment 2

Figure 6:
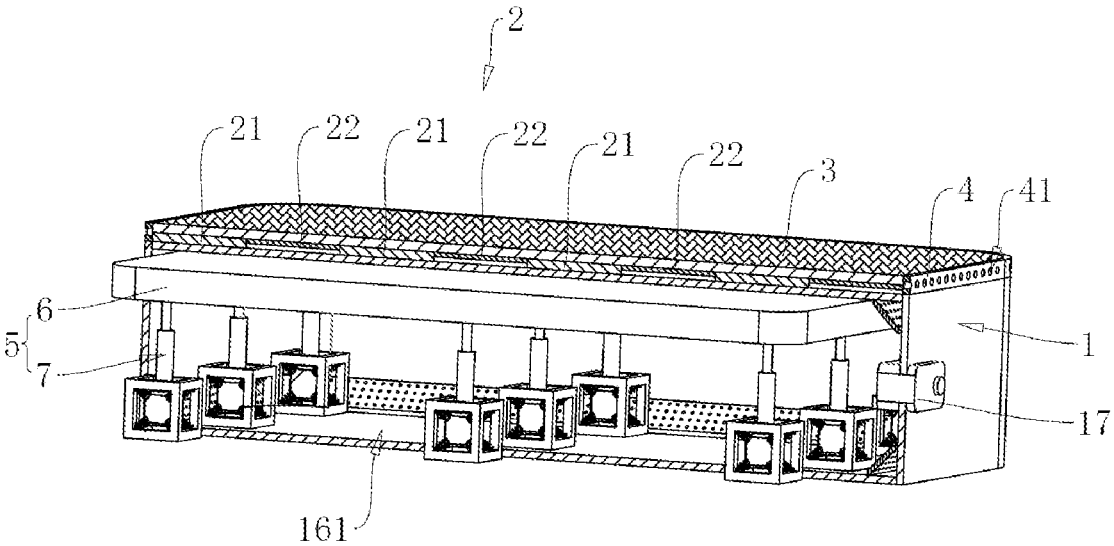
FIG. 6 is a sectional view of an inflatable bed with air permeability according to Embodiment 2 of the present application.

Embodiment 2 differs from Embodiment 1 in that:

With reference to FIG. 6, a support device 5 for supporting the sponge pad 2 and the top cover 3 is further provided in the main cavity 161 of the bed body 1, and in particular, the support device 5 includes a bearing board 6 and a plurality of support mechanisms 7. The bearing board 6 passes through a loop formed by the first pull strap 14, the top of the bearing board 6 abuts against the lower surface of the top panel 11, and the plurality of support mechanisms 7 are distributed in a rectangular array so as to have a stable supporting effect on the bearing board 6.

Continuing to refer to FIG. 6, in particular, the bottom end of each support mechanism 7 is fixedly connected to the bed body 1, and the top end of each support mechanism 7 is fixedly connected to the bearing board 6 configured for supporting the sponge pad 2 and the top cover 3. The plurality of support mechanisms 7 have a stable supporting effect on the bearing board 6, and the bearing board 6 has a supporting effect on the sponge pad 2 and the top cover 3 on the surface of the bed body 1, so as to ensure that the inflatable bed is not intended to deform during a long-term use, thereby extending the service life of the inflatable bed as a whole.

Figure 7:
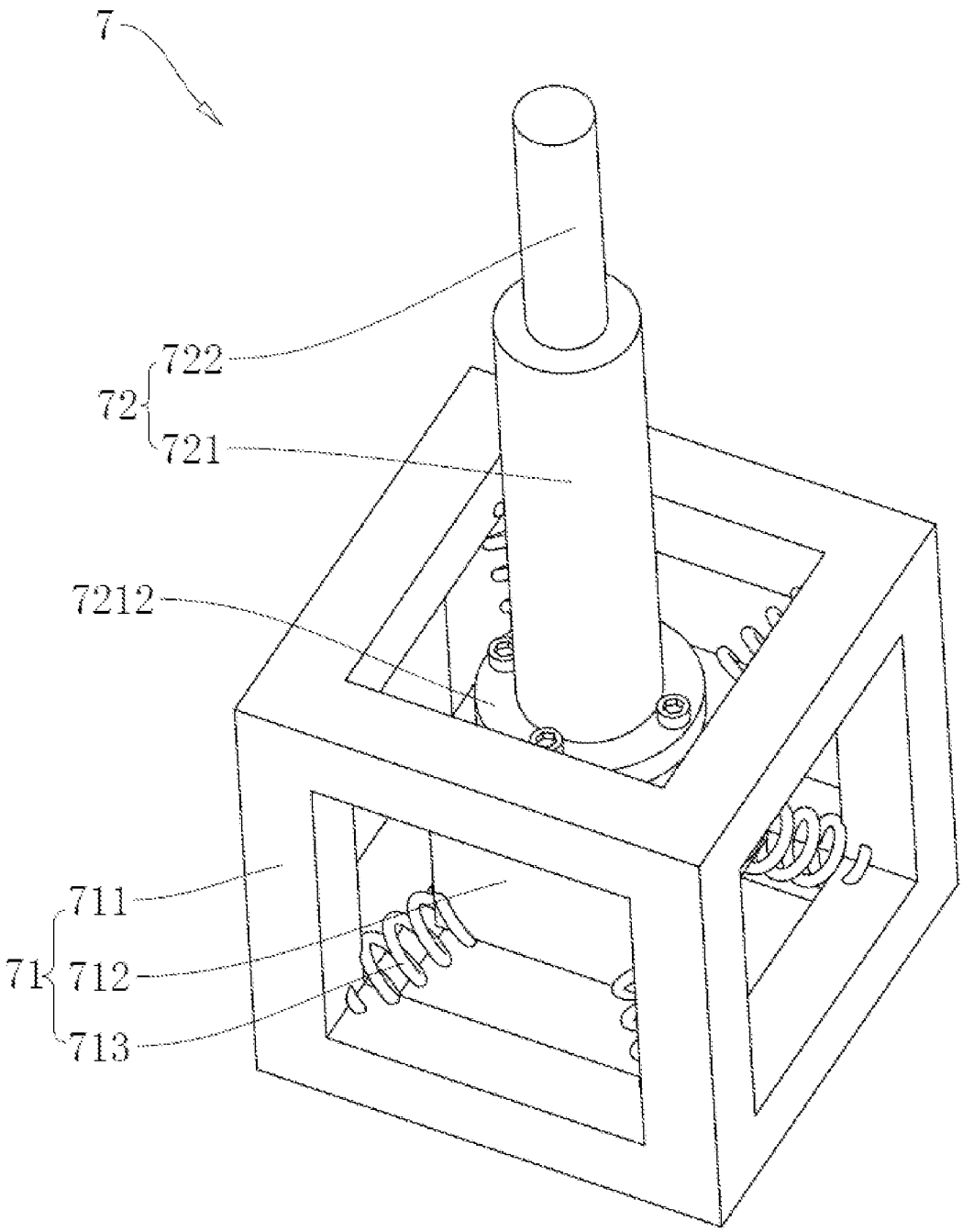
FIG. 7 is a schematic structural diagram showing a support mechanism according to Embodiment 2 of the present application.

Referring to FIGS. 6 and 7, each support mechanism 7 includes the first buffer assembly 71 in the bed body 1 and the second buffer assembly 72 on the first buffer assembly 71, the second buffer assembly 72 is configured for supporting the bearing board 6 for supporting the sponge pad 2 and the top cover 3. The first buffer assembly 71 has an upward supporting effect on the second buffer assembly 72 which has an upward supporting effect on the bearing board 6, and at the same time, the first buffer assembly 71 and the second buffer assembly 72 have a buffering effect at the same time, so that a person sleeps more comfortably.

Referring to FIG. 7, specifically, the first buffer assembly 71 includes a bracket 711, a buffer block 712, and a plurality of first elastic elements 713. In the present embodiment, the bracket 711 is fixed to the upper surface of the bottom panel 13, the bracket 711 has a hollow structure, and the buffer block 712 is located in the bracket 711. In the present embodiment, eight first elastic elements 713 are provided, and the eight first elastic elements 713 are symmetrical to each other. One end of each first elastic element 713 is connected to a corner of the buffer block 712, and the other end of each first elastic element 713 is connected to the bracket 711. The four first elastic elements 713 located above pull the buffer block 712 upwards, and the four first elastic elements 713 located below support the buffer block 712 upwards, particularly, the first elastic element 713 may be a spring. The second buffer assembly 72 is provided on the upper surface of the buffer block 712. Since the bracket 711 is fixed in the bed body 1, the bed body 1 plays a role in fixing and supporting the bracket 711. Because one end of each first elastic element 713 is connected to the buffer block 712, and the other end of each first elastic element 713 is connected to the bracket 711, also, because the second buffer assembly 72 is provided on the buffer block 712, when a person generates pressure on the top cover 3, the sponge pad 2 and the bearing board 6 when sleeping, the bearing board 6 in turn generates pressure on the second buffer assembly 72, the second buffer assembly 72 generates pressure on the buffer block 712, and the plurality of first elastic elements 713 are elastically deformed at the same time by means of the buffer block 712. Therefore, when the sleeping posture of the person is changed, the plurality of first elastic elements 713 generate an upward elastic force due to their own elastic potential energy, thereby ensuring that the top cover 3 and the sponge pad 2 are changed with the change of the sleeping posture, thus improving the overall comfort.

Figure 8:
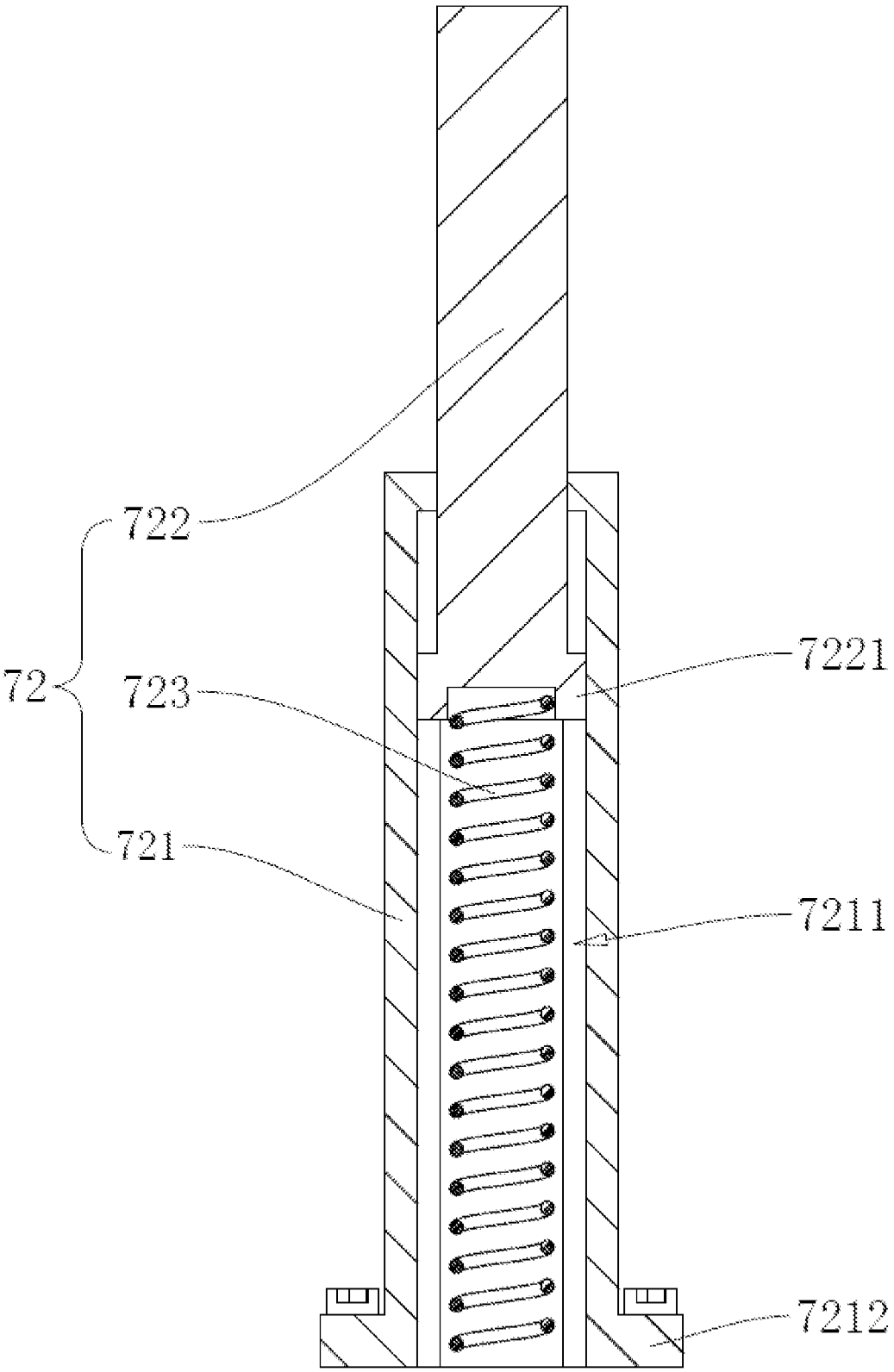
FIG. 8 is a half sectional view of a second buffer assembly according to Embodiment 2 of the present application.

Referring to FIGS. 6 and 8, specifically, the second buffer assembly 72 includes a guide cylinder 721, a support rod 722 and a second elastic element 723, particularly, the bottom end of the guide cylinder 721 is fixedly connected to the buffer block 712, and both ends of the guide cylinder 721 are open. The top end of the support rod 722 is fixedly connected to the bearing board 6, the bottom end of the support rod 722 is located in the guide cylinder 721, and the support rod 722 is in sliding fit with the guide cylinder 721. The second elastic element 723 is located in the guide cylinder 721, a limiting slot is defined at the bottom end of the support rod 722, the top end of the second elastic element 723 abuts against the bottom of the limiting slot, the limiting slot limits the position of the top end of the second elastic element 723, specifically, the second elastic element 723 may be a spring. The bottom end of the second elastic element 723 abuts against the surface of the buffer block 712, and the guide cylinder 721 limits the position of the bottom end of the second elastic element 723. Both ends of the guide cylinder 721 are open, such that it is convenient for a worker to insert the second elastic element 723 and the support rod 722 into the guide cylinder 721. When a person generates a pressure on the top cover 3, the sponge pad 2 and the bearing board 6 when sleeping, the bearing board 6 presses the support rod 722 to descend, the support rod 722 compresses the second elastic element 723 in the process of descending, at this time, the plurality of first elastic elements 713 and the plurality of second elastic elements 723 are all elastically deformed. Therefore, when the sleeping posture of the person is changed, the plurality of first elastic elements 713 and the plurality of second elastic elements 723 generate an upward elastic force due to their own elastic potential energy, thereby ensuring that the top cover 3 and the sponge pad 2 are changed with the change of the sleeping posture, thus improving the overall comfort.

Referring to FIG. 8, both sides of the inner side wall of the guide cylinder 721 opposite to each other are configured with a guide groove 7211, respectively, and both guide grooves 7211 extend in the vertical direction. The bottom end of each guide groove 7211 is open. Two sides of the support rod 722 opposite to each other are integrally formed with a guide block 7221, respectively, the two guide blocks 7221 are respectively located in the guide grooves 7211, and the two guide blocks 7221 are respectively in sliding fit with the two guide grooves 7211. The bottom end of the guide groove 7211 is open, such that it is convenient to push the guide block 7221 into the guide groove 7211 from the bottom end of the guide groove 7211. When the support rod 722 slides in the guide cylinder 721, the guide blocks 7221 slide in the guide grooves 7211, and the guide grooves 7211 have a guiding effect on the guide blocks 7221, which increases the sliding stability of the guide blocks 7221, thereby increasing the sliding stability of the support rod 722.

Continued referring to FIG. 8, the outer side wall of each guide cylinder 721 at the bottom end is integrally formed with a fixed ring 7212, whose lower surface abuts against the upper surface of the buffer block 712. A plurality of bolts extend through the fixed ring 7212, which are uniformly arranged in the circumferential direction. Each bolt is in threaded engagement with the buffer block 712 to secure the fixed ring 7212 and the guide cylinder 721 to the buffer block 712, while also increasing the ease of installation and removal of the guide cylinder 721 by personnel.

Embodiment 3

Embodiment 3 differs from embodiment 1 as follows.

Figure 9:
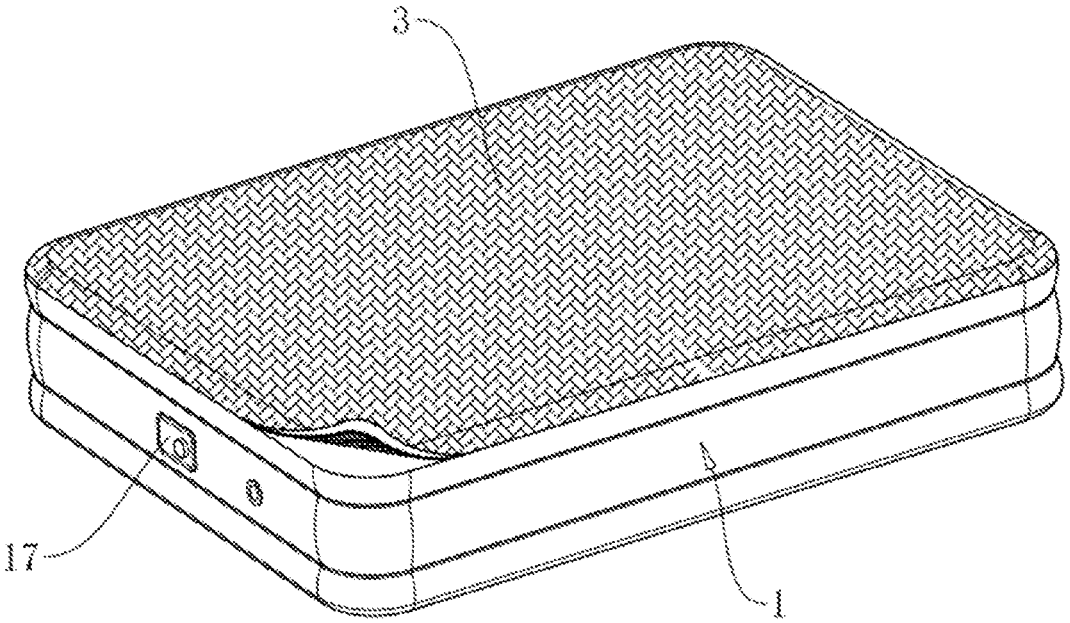
FIG. 9 is a schematic structural diagram showing an inflatable bed with air permeability according to Embodiment 3 of the present application.

Referring to FIG. 9, the edge of the top cover 3 isn't fixedly connected with the bed body 1 through the side border 4, but is directly connected with the edge of surface of the bed body 1.

The above are the preferred embodiments of the present application, and the protection scope of the present application is not limited thereby, therefore, equivalent changes made according to the structure, shape and principle of the present application shall be covered by the protection scope of the present application.

LIST OF REFERENCE SIGN

1 bed body
11 top panel
12. enclosing wall
13 bottom panel
14 first pull strap
141 first air permeable section
142 second air permeable section
143 connection section
144 air vent
15 second pull strap
16 inner cavity
161 main cavity
162 upper cavity
163 lower cavity
17 air pump
2 sponge pad
21 first subzone
22 second subzone
3 top cover
31 first air hole
4 side border
41 second air hole
5 support device
6 bearing board
7 support mechanism
71 first buffer assembly
711 bracket
712 buffer block
713 first elastic element
72 second buffer assembly
721 guide cylinder
7211 guide groove
7212 fixed ring
722 support rod
7221 guide block
7222 limiting slot
723 second elastic element

What is claimed is:

1. An inflatable bed with air permeability, comprising a bed body and a top cover, wherein the top cover is connected to the bed body and is configured with a plurality of first air holes, a sponge pad is provided between the bed body and the top cover, the bed body comprises a top panel, an enclosing wall and a bottom panel, the enclosing wall is annular, an edge of the top panel is fixedly connected to a top end of the enclosing wall, and an edge of the bottom panel is fixedly connected to a bottom end of the enclosing wall, wherein the inflatable bed with air permeability further comprises a first pull strap and a second pull strap, the first pull strap and the second pull strap are both endless, a top side of the first pull strap is connected to an inner wall of the top panel, and a bottom side of the first pull strap is connected to an inner side wall of the enclosing wall, wherein a bottom side of the second pull strap is connected to an inner wall of the bottom panel, and a top side of the second pull strap is connected to the inner side wall of the enclosing wall, and wherein the first pull strap comprises two first air permeable sections, two second air permeable sections and four connection sections, wherein the two first air permeable sections are parallel to each other, the two second air permeable sections are parallel to each other, the four connection sections are distributed in a rectangular array, and the two first air permeable sections and the two second air permeable sections are respectively in a net shape.

2. The inflatable bed with air permeability according to claim 1, wherein a surface of the bed body is provided with an annular side border, and an edge of the top cover is fixedly connected to the annular side border.

3. The inflatable bed with air permeability according to claim 2, wherein a plurality of second air holes are defined on the annular side border.

4. The inflatable bed with air permeability according to claim 2, wherein the sponge pad is located in the annular side border.

5. The inflatable bed with air permeability according to claim 1, wherein the plurality of first air holes are micro-holes.

6. The inflatable bed with air permeability according to claim 1, wherein a support device comprising a bearing board and a plurality of support mechanisms is provided in the bed body, a bottom end of each of the plurality of support mechanisms is fixedly connected to the bed body, a top end of each of the plurality of support mechanisms is fixedly connected to the bearing board, and the bearing board is configured to support the sponge pad and the top cover.

7. The inflatable bed with air permeability according to claim 6, wherein each of the plurality of support mechanisms comprises a first buffer assembly and a second buffer assembly, the first buffer assembly is provided in the bed body, the second buffer assembly is provided on the first buffer assembly, the second buffer assembly is configured to support the bearing board, and a side of the bearing board away from the second buffer assembly abuts against the bed body.

8. The inflatable bed with air permeability according to claim 7, wherein the first buffer assembly comprises a bracket, a buffer block and a plurality of first elastic elements, the bracket is fixed in the bed body, the buffer block is located in the bracket, a first end of each of the plurality of first elastic elements is connected to the buffer block, a second end of each of the plurality of first elastic elements is connected to the bracket, and the second buffer assembly is provided on the buffer block.

9. The inflatable bed with air permeability according to claim 8, wherein the second buffer assembly comprises a guide cylinder, a support rod and a second elastic element, two ends of the guide cylinder are open, a bottom end of the two ends of the guide cylinder is fixedly connected to the buffer block, a top end of the support rod is fixedly connected to the bearing board, a bottom end of the support rod is located in the guide cylinder, the support rod is in sliding fit with the guide cylinder, the second elastic element is located in the guide cylinder, a top end of the second elastic element abuts against the support rod, and a bottom end of the second elastic element abuts against a surface of the buffer block.

10. The inflatable bed with air permeability according to claim 9, wherein an inner side wall of the guide cylinder is configured with a guide groove, a bottom end of the guide groove is open, a guide block is fixedly provided on the support rod, the guide block is located in the guide groove, and the guide block is in sliding fit with the guide groove.

11. The inflatable bed with air permeability according to claim 1, wherein the sponge pad is provided with a plurality of first subzones and a plurality of second subzones, the plurality of first subzones and the plurality of second subzones are successively arranged at intervals along a length direction of the sponge pad, and a thickness of the plurality of first subzones is greater than a thickness of the plurality of second subzones.

12. The inflatable bed with air permeability according to claim 1, wherein an edge of the top cover is fixedly connected with the bed body.

13. An inflatable bed with air permeability, comprising a bed body and a top cover, wherein the top cover is connected to the bed body and is configured with a plurality of first air holes, and a sponge pad is provided between the bed body and the top cover, wherein a support device comprising a bearing board and a plurality of support mechanisms is provided in the bed body, a bottom end of each of the plurality of support mechanisms is fixedly connected to the bed body, a top end of each of the plurality of support mechanisms is fixedly connected to the bearing board, and the bearing board is configured to support the sponge pad and the top cover, wherein each of the plurality of support mechanisms comprises a first buffer assembly and a second buffer assembly, the first buffer assembly is provided in the bed body, the second buffer assembly is provided on the first buffer assembly, the second buffer assembly is configured to support the bearing board, and a side of the bearing board away from the second buffer assembly abuts against the bed body, wherein the first buffer assembly comprises a bracket, a buffer block and a plurality of first elastic elements, the bracket is fixed in the bed body, the buffer block is located in the bracket, a first end of each of the plurality of first elastic elements is connected to the buffer block, a second end of each of the plurality of first elastic elements is connected to the bracket, and the second buffer assembly is provided on the buffer block.

* * * * *